United States Patent [19]

Mittelbach et al.

[11] 4,393,290

[45] Jul. 12, 1983

[54] PUFFER-TYPE GAS BLAST SWITCH

[75] Inventors: Günter Mittelbach, Kassel; Günter Horstmann, Gudensberg; Werner Heiss, Kassel; Dietrich Hoffmann, Kassel-Kirchditmold; Günter Siebrecht; Karl Kriechbaum, both of Kassel; Günter Rapp, Kassel-B, all of Fed. Rep. of Germany

[73] Assignee: Licentia Patent-Verwaltungs-GmbH, Frankfurt am Main, Fed. Rep. of Germany

[21] Appl. No.: 128,897

[22] Filed: Mar. 10, 1980

[30] Foreign Application Priority Data

| | | | |
|---|---|---|---|
| Mar. 9, 1979 | [DE] | Fed. Rep. of Germany | 2909264 |
| Mar. 9, 1979 | [DE] | Fed. Rep. of Germany | 2909270 |
| Oct. 22, 1979 | [DE] | Fed. Rep. of Germany | 2942624 |
| Oct. 22, 1979 | [DE] | Fed. Rep. of Germany | 2942625 |
| Oct. 22, 1979 | [DE] | Fed. Rep. of Germany | 2942626 |
| Oct. 22, 1979 | [DE] | Fed. Rep. of Germany | 2942627 |

[51] Int. Cl.[3] ..... H01H 33/88

[52] U.S. Cl. ..... 200/148 A; 200/146 R

[58] Field of Search ..... 200/148 A, 150 G, 146 R

[56] References Cited

U.S. PATENT DOCUMENTS 3,924,088 12/1975 Heutschi et al. ..... 200/148 A

FOREIGN PATENT DOCUMENTS 2627948 1/1978 Fed. Rep. of Germany .

*Primary Examiner*—Robert S. Macon

*Attorney, Agent, or Firm*—Spencer & Kaye

[57] ABSTRACT

A puffer-type gas blast circuit interrupter composed of two separable contacts defining a power current path and between which an arc is created upon separation movement, in which the movable parts of the gas compressor and/or the region of contact between the contacts of an associated nominal current path are shielded from the region in which the arc is created by a shielding arrangement composed of a stationary cylinder surrounding the nozzle associated with the gas compressor and a shield member carried by the nozzle. Additionally, to reduce the movable mass of the interrupter, at least one of the current paths is constituted by two stationary contact pieces and a movable contact member carried by, and projecting from, the cylinder of the gas compressor. Further, the mass of the moving parts of the system is reduced by providing the shield member carried by the nozzle with a cylindrical projection coaxial with, and slidable relative to, the stationary cylindrical member. Preferably, the interface between the shield member and the cylindrical member is hermetically sealed.

12 Claims, 6 Drawing Figures

19
21
18
2
16
4
20
14
15
13
5
12
17
7
6
1
3
11
10
8
9
OFF 19
21
18
2
216
4
20
14
216a
15
13
5
12
224a
224
7
6
224b
1
3
211
10
8
9
OFF 19
21
18
2
216
4
20
14
216a
15
13
5
12
224a
211d
224
211b
211b
7
211c
225
X
6
X
1
3
211a
10
8
9
OFF

PUFFER-TYPE GAS BLAST SWITCH

BACKGROUND OF THE INVENTION

The present invention relates to gas blast switches of the puffer type.

German Offenlegungsschrift [Laid-Open Application] No. 2,627,948 discloses a gas blast switch of this type in which the predominant portion of the electric arc cloud, the plasma, is conveyed out of an insulating nozzle into a space between the insulating nozzle and a solid countercontact of the switching path. Due to the lower energy of electric arcs in such environment compared to that in air, it is possible with this simple quenching arrangement to handle currents of up to about 63 kA at voltages of 140 kV per switching path. When higher currents are to be switched off, the plasma disposed in the space between the insulating nozzle and the countercontact acts in such a manner that high value transient voltages can no longer be supported because the presence of the plasma between the conductive faces of the movable parts of the switching path gas compressor and the stationary contact piece of the switching path provides an opportunity for flashover or re-ignition, that means after extinguishing the arc, it may happen that the arc re-ignites, for example, owing to a great slope of the building-up voltage of the switching path. In the following, this phenomenon is called flashover.

Although it has been attempted, with the structure disclosed in the above mentioned Offenlegungsschrift, to realize a certain shielding of these parts by a plasma rejecting outer shape of the insulating nozzle and by the provision of insulating members at the cylinder of the switching path compressor and at the contact pieces, such shielding is not complete enough because it is able to shield only a few parts to a certain degree. Moreover, such a structure becomes relatively expensive, particularly since it includes spring tensioned insulating members.

SUMMARY OF THE INVENTION

It is an object of the present invention to provide such a switch with shielding which is optimally effective and structurally simple.

These and other objects are achieved, according to a first aspect of the invention, in a puffer-type gas blast circuit interrupter switch including means defining two separable contacts between which an arc is created upon contact separation, a nozzle of insulating material disposed for directing a stream of gas against such arc, and means defining a compressor operable by separation movement of the contacts to supply a mass of gas under pressure to the nozzle, by providing the switch with a cylindrical member enclosing the region in which such arc is formed, mounting the nozzle to be movable relative to the cylindrical member and providing the nozzle with a shield member in sliding contact with the cylindrical member for guiding the movement of the nozzle relative to the cylindrical member.

In the puffer-type gas blast switch according to the present invention, as defined above, the chamber, or region, in which the arc cloud, or plasma, and the stationary countercontact are disposed is directly separated from other chambers, provided in the interrupter and containing the conductive faces of the movable contact system, so that the flashover capability is greatly reduced, i.e. the voltage resistance is greatly increased. Thus it is not necessary to individually shield individual parts, but rather the gas chamber in which the arc cloud is disposed is shielded directly.

The cylindrical member may be a pipe of insulating material or of metal. Alternatively, an externally metallized pipe of insulating material would be conceivable.

If a gas blast switch exists in which, in order to increase the rated current, a rated, or nominal, current path is provided in addition to, and electrically in parallel with, the power contact pieces between which the arc burns, the arrangement is advisably such that the contact transfer point between the contact pieces of the rated current path is essentially shielded against the arc radiation and the substantial portion of the arc erosion products.

If in this case the cylindrical member is a pipe of insulating material, the contact pieces of the rated current path are arranged, according to a further feature of the invention, outside the insulated pipe, so that the contacts of the rated current path can then not have a power reducing effect. With the above-mentioned separation of the gas chambers the danger of flashover between the contact pieces of the rated current path during switching of high currents is also reduced considerably.

If the cylindrical member is a metal pipe, this metal pipe advisably forms directly a contact piece of the rated current path whose other contact piece encloses the metal pipe on the outside.

Advisably the partitioning is then effected in an essentially gastight manner so that the arc gases cannot escape between the insulated nozzle and the cylindrical member.

In the gas blast switch disclosed in German Offenlegungsschrift No. 2,627,948, a rated current path is connected electrically in parallel with the power current path formed of the power contact pieces and an insulating shielding is provided for the movable contact piece of the rated current path in the form of an insulated pipe and an insulated piston so as to avoid the danger of flashover between the rated current contacts when higher currents are switched off. The other, stationary contact piece of the rated current path in this prior art gas blast switch, however, is relatively unprotected and exposed to the arc radiation and the arc fission products although the outer configuration of the insulating nozzle provides certain protection. In this prior art switch the point of contact between the contact pieces of the rated current path can therefore be adversely influenced when high currents are being switched.

It is therefore a further object of the invention to provide a shielding for such switches so that the point of contact between the contact pieces of the rated current path will not be adversely influenced by the arc.

This and other objects are accomplished, according to the present invention, in a puffer-type gas blast circuit interrupter switch including means defining two separable power current conducting contacts between which an arc is created upon contact separation, a nozzle of insulating material disposed for directing a stream of gas against such arc, means defining a compressor operable by separation movement of the contacts to supply a mass of gas under pressure to the nozzle, and means defining a nominal current path including two additional separable contacts in parallel with the power current conducting contacts, the additional separable contacts being mounted to open before the power current conducting contacts, by providing the switch with shielding means disposed for shielding the contact region of the additional contacts from the region in which such arc is formed.

In order to reduce the flashover capability between the conductive faces of the contact systems of the power and nominal current paths, the gas blast switch defined above is thus provided with a shielding which is advantageously designed and arranged in such a manner that it simultaneously encloses the chamber into which flow the arc gases. The shielding is preferably provided with a cylindrical member within which the insulating nozzle is guided in a sliding manner. The insulating nozzle is provided with a correspondingly designed shield.

The above-mentioned shielding takes care, in particular, that the point of contact between the contact pieces of the rated current path is not adversely influenced when high currents are being switched off.

The shielding may be in the form of a metal pipe or an insulated pipe. In the case of a metal pipe, the latter is advisably designed directly as a contact piece for the rated current path and is contacted on its outside surface by the other contact piece.

Particularly in connection with the shielding of the present invention it is a further object of the invention to reduce the moved masses in the switch.

This and other objects are accomplished according to the present invention, in a puffer-type gas blast circuit interrupter switch including means defining two separable power current conducting contacts between which an arc is created upon contact separation, a nozzle of insulating material disposed for directing a stream of gas against such arc, means including a stationary piston and a movable cylinder defining a compressor operable by separation movement of the contacts to supply a mass of gas under pressure to the nozzle, a cylindrical member enclosing the region in which such arc is formed and the nozzle, a shield member forming part of the nozzle, shaped to correspond with the cylindrical member and slidingly engaging the cylindrical member for guiding movement of the nozzle relative to the cylindrical member, and means defining an interruptable rated current conducting path in parallel with the power current conducting contacts, the rated current conducting path being interruptable before separation of the power current conducting contacts, by forming the rated current conducting path of two stationary contact pieces spaced from one another and a contact bridging member mounted on the cylinder for connecting the stationary contact pieces together when the switch is closed.

With this solution according to the invention it is possible to reduce the cross sections of the cylinder, resulting in the desired reduction of the moved masses. The cross sections of the stationary contact pieces may be dimensioned generously so that high rated currents can be transmitted. The solution according to the present invention also provides good possibilities for cooling.

Further objects of the invention are achieved, in a puffer-type gas blast circuit interrupter switch including means defining two separable power current conducting contacts between which an arc is created upon contact separation, means including a piston-cylinder unit having a stationary part and a movable part and operable by separation movement of the contacts to generate a mass of gas under pressure and direct that gas in a stream against such arc, by further providing the switch with a stationary contact piece directly engaging the movable part of the piston-cylinder unit in a conductive manner. This switch may be provided with an upper, plate-shaped electrical terminal and a lower, plate-shaped electrical terminal. The power conducting contacts can be formed by a stationary power contact pin which is conductively connected with the upper terminal plate and a movable power contact which constitutes the arc contact. This movable power contact is conductively connected with a movable cylinder which cooperates with a stationary piston attached to the lower terminal plate to form a switching path compressor for generating the required blast pressure during switching. The movable piston may be conductively connected with a fork for the application of switching force and the conduction of current, which fork itself is in communication with a drive rod. The drive rod may be actuated by a hydraulic or pneumatic spring drive or the like and is guided internally by supports to whose lower end the drive is attached. The fork may be in conductive connection with the lower terminal plate via high current contacts.

In a switch of such design, a parallel rated current contact path may be provided to increase the current carrying capability and may include two hollow cylindrical contact pieces. The upper parallel contact piece is then conductively connected with the upper terminal plate and is stationary. The lower parallel contact piece is conductively connected with the movable cylinder and is thus moved together with the cylinder. The rated current contact path is matched to the power current path in such a way that during switch-off the rated current path opens shortly before the power current path opens so that an arc is established only in the power current path.

Although this switch already realizes considerable advantages compared to the prior art switches it is limited in its current carrying capability. It is therefore desired to realize greater current carrying capability in a switch of the simplest possible design and provided with shielding.

This is accomplished by the present invention with the previously-described structure which includes a stationary contact piece which directly engages the movable part of the compressor piston-cylinder unit in a conductive manner. Therefore, the relatively massive cylinder is utilized to carry current; due to the large mass of the cylinder and the stationary contact piece there results a very high current carrying capability at low manufacturing cost.

If a gas blast switch is provided in which, in order to increase the rated current, a rated current path is provided in addition to, and electrically in parallel with, the power contact pieces between which the arc is created, the arrangement is advisably made so that the contact point of connection between the contact pieces of the rated current path is shielded against the arc radiation and the essential portion of the arc erosion products. By separating the gas chambers, the danger of flashover between the contact pieces of the rated current path during the switching of high currents is likewise reduced considerably. If the arc chamber is formed by a cylindrical member in the form of a metal pipe, this metal pipe advisably forms a contact piece of the rated current path whose other contact piece encloses the metal pipe on the outside.

This design already results in significant advantages over prior art switches.

In order to obtain the required electrical striking distance between the metal pipe and the cylinder, which can be attained by shortening the metal pipe, the insulated nozzle of this design must be relatively long and consequently becomes heavy. The insulating capability of the insulating nozzle can also be improved further.

It is therefore a further object of the invention to provide an insulating nozzle which has the highest possible insulating capability with the lowest possible weight.

This object is accomplished, according to the invention, in any one of the embodiments described above and including a stationary cylindrical member and a nozzle provided with a shield member slidable in the cylindrical member and defining therewith a chamber enclosing the region in which the arc is created, by constructing the shield member to include a cylindrical extension oriented coaxially with, and slidable along, the cylindrical member.

BRIEF DESCRIPTION OF THE DRAWING

Each of FIGS. 1-5 is a cross-sectional side elevational view of a respective preferred embodiment of a puffer-type gas blast circuit interrupter according to the invention.

DESCRIPTION OF THE PREFERRED EMBODIMENTS

Figure 1:
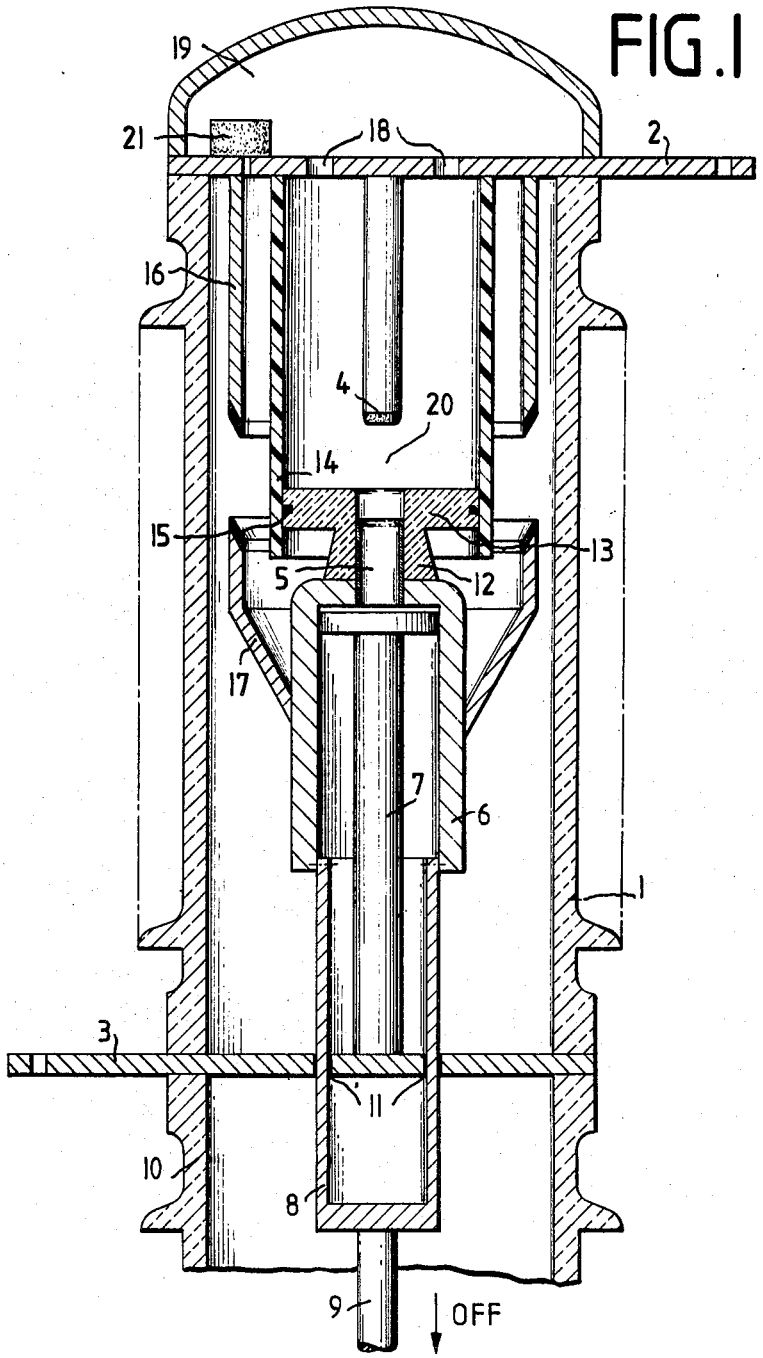

FIG. 1 shows one switching pole of a high voltage gas blast circuit breaker located within an insulating housing 1, and constituted by a contact system disposed in a closed switching chamber. The switch includes an upper, plate-shaped, electrical terminal 2 and a lower, plate-shaped electrical terminal 3 for connection into a current path to be switched. The power path at which the circuit is to be broken is formed by a stationary power contact member 4 in the form of a pin which is permanently conductively connected to the upper terminal plate 2, and a movable power contact 5.

The movable power contact 5 is conductively connected to a movable cylinder 6 which cooperates with a stationary piston 7 attached to the lower terminal 3 so as to form a gas compressor for generating the required blast pressure to aid in extinguishing the arc occurring during circuit opening. The movable piston 6 is conductively connected to a fork 8 for conducting current to and from contact 5 and applying displacement force to cylinder 6. Fork 8 is secured to a drive rod 9. The drive rod is actuated in the usual manner by a hydraulic or pneumatic spring drive or the like; it is internally guided by supports 10 whose lower end accommodates the drive.

The fork 8 is in conductive connection with the lower terminal plate 3 via high current slide contacts 11.

In the region of the movable power contact 5, a nozzle 12 of electrical insulating material is permanently connected with the movable piston 6. The gas which has been compressed in the compression chamber formed between elements 6 and 7 at the start of switch-off exits from this nozzle 12 and blows on the switching arc formed between the power contacts 4 and 5.

Insulating nozzle 12 has a shield portion 13 which is slidingly guided in a stationary cylinder 14 also of insulating material, connected to the upper terminal plate 2. Advisably the interface between the cylinder 14 of insulating material and the shield portion 13 is made gastight.

According to a particular feature of the present invention, the gastight seal between the shield portion 13 of the insulating nozzle 12 and the cylinder 14 of insulating material, which creates a gastight isolation of the chamber in which there is disposed the arc plasma 20, is created by means of a gasket 15, e.g. of Teflon.

Between the cylinder 14 of insulating material and the housing 1, i.e. in an area which is shielded against the plasma cloud formed by the arc, there is provided a parallel rated current contact path in order to increase current carrying capability, this contact path being formed of two essentially cylindrical contact pieces 16 and 17. The upper parallel contact piece 16 is conductively connected with the upper terminal plate 2 and is stationary. The lower parallel contact piece 17 is conductively connected with the movable cylinder 6 and is thus moved together with the cylinder 6. The rated current contact path 16, 17 is arranged relative to the power current path 4, 5 in such a manner that during switch-off the rated current path opens shortly before the power current path so that the resulting arc exists only in the power current path.

The illustrated switch operates as follows.

In the switched-on state (not shown) current flows between the upper terminal plate 2 and the lower terminal plate 3 through the two current paths, the rated current path 16, 17 and the power current path 4, 5, the cylinder 6, the fork 8 and the high current contacts 11.

If the drive rod 9 is then moved in the off direction, i.e. downwardly, by the drive, the two current paths are separated, as shown, and a switching arc is created between the power contacts 4, 5. The downward movement of cylinder 6 compresses the insulating gas, usually $SF_6$, in the chamber defined with piston 7 until contact piece 5 clears the lower end of contact 4, whereupon the compressed gas is excited in the form of a high pressure blast upwardly through the insulating nozzle 12 so that it blows on the arc, thus conveying the arc plasma from the region of nozzle 12 into the area 20 between nozzle 12 and stationary contact 4. The gas escapes through openings 18 in the upper terminal plate into the dome 19 of the switching chamber from where it returns into the switching chamber through a filter 21.

Due to the fact that the parallel path located between housing 1 and insulating cylinder 14 required for conducting higher rated currents, on the one hand, and the insulating nozzle 12, on the other hand, are provided with a shield portion 13 which is sealed against the cylinder 14 of the insulating material to form a separate gastight chamber 20 which is electrically insulated toward the side and the bottom and within which the arc plasma is disposed after switch-off, the flashover capability between the conductive members 4 and 6 of the power current path, and particularly between contacts 16, 17 of the parallel rated current path is reduced enormously, i.e. the additional conductive areas of the parallel rated current path do not have a power reducing effect with respect to the switch-off capability. Therefore it is possible in the illustrated embodiment that even if higher currents are switched, transient voltages having high voltage values can be supported, i.e. the illustrated embodiment of the invention makes possible the construction of puffer-type high voltage power switches which are capable of switching high currents at high voltages, i.e. which have a high switch-off power.

Various modifications of the embodiment illustrated in FIG. 1 are conceivable without departing from the scope of the invention.

For example, the insulating nozzle or its shield, respectively, may have various configurations; the important thing is that the region 20 in which the plasma cloud occurs is essentially sealed by the cylinder 14 and the shield 13, if necessary with the aid of sealing means, such as sealing ring 15, for example. This reduces the flashover capability, i.e. the voltage carrying capability is increased enormously. If the requirements for voltage carrying capability are lower, the requirements for gas-tightness can be kept lower.

Various embodiments are also conceivable for the configuration of the parallel contact path which is advisable to conduct high rated currents. The corresponding contacts may be cylindrical or bar-shaped individual contacts. The important point is that, if they are provided, they are shielded by the cylinder 14 with respect to the area 20 containing the plasma cloud, i.e. against the arc radiation as well as against precipitation of a significant portion of the arc erosion products so that the contact point is not adversely influenced by the arc.

If the cylinder 14 is formed of a metal pipe, this metal pipe may directly consistute the stationary contact 16 of the rated current path and may be enclosed externally by, and contact, the movable contact piece 17.

The stationary contact piece 16 of the rated current path may also be formed by an outer metallic coating on an insulating cylinder 14.

Figure 2:
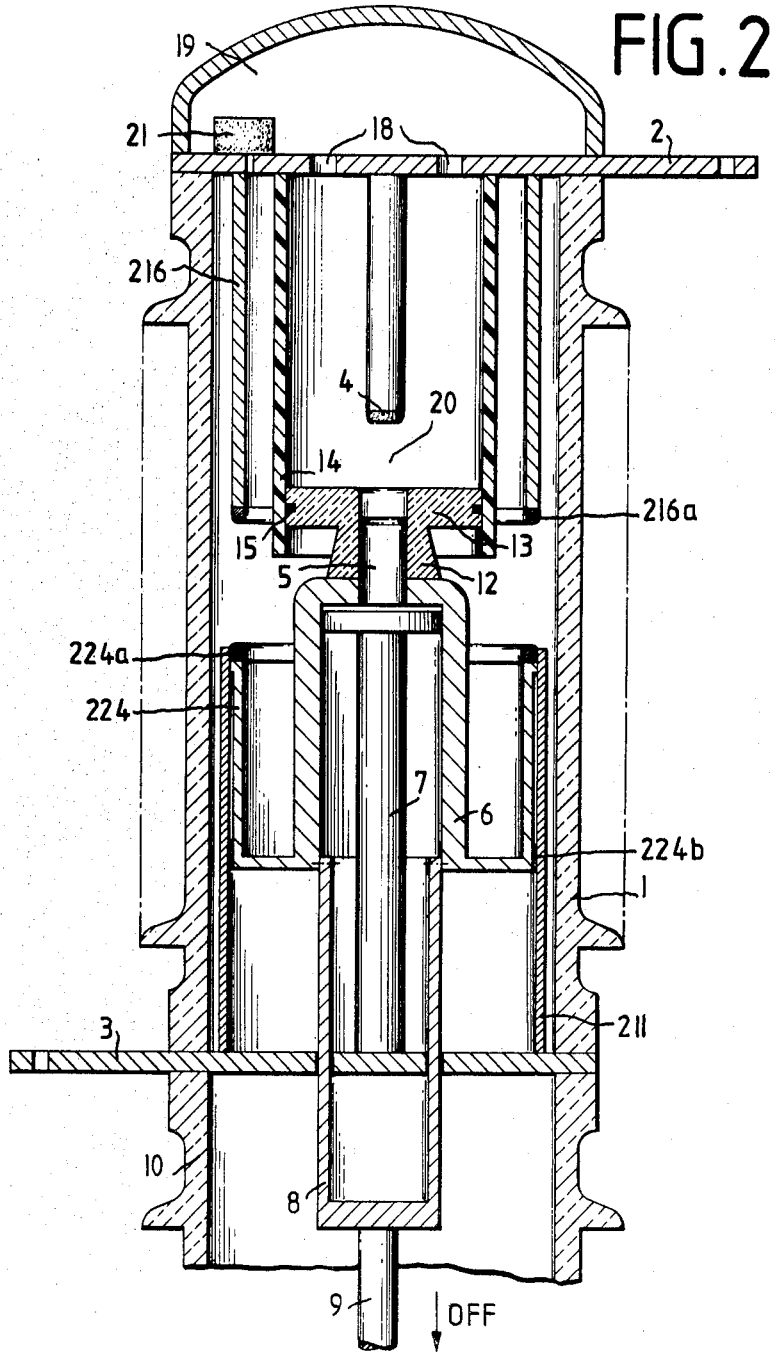

FIG. 2 shows an embodiment of a switch pole of a puffer-type high voltage gas blast power switch corresponding in part to the switch of FIG. 1.

In the embodiment of FIG. 2, the movable cylinder 6 is again connected to a fork 8 which itself is in communication with a drive rod 9. The drive rod 9 is actuated in the usual manner by means of a hydraulic or pneumatic spring drive or the like; in its interior it is guided by supports 10 to whose lower end is attached the drive.

As in the switch of FIG. 1, in the area of the movable power contact 5 there is permanently connected to the movable piston 6 an insulating nozzle 12 from which exits the gas that has been compressed at the start of switch-off in the switching path compressor 6, 7 and blows against the switching arc formed between the power contacts 4,5. This insulating nozzle 12 has a shield portion 13 which is slidingly guided in a stationary cylinder 14 of insulating material which is connected to the upper terminal plate 2.

According to one advantageous embodiment of the invention (not shown) a metal pipe may be provided instead of the cylinder 14 of insulating material, which pipe directly constitutes the rated current contact piece, thus keeping the diameters of the various components smaller.

Between the cylinder 14 of insulating material and the insulating housing 1, i.e. in an area which is shielded from the plasma cloud generated by the arc, there is provided a parallel rated current contact piece 216 to increase the rated current carrying capability. This upper parallel contact piece 216 is conductively connected with the upper terminal plate 2, has the form of a cylinder, and is stationary. Essentially in line therewith there is disposed a corresponding further contact piece 211 which is in conductive connection with the lower terminal plate 3, and is thus also stationary, and is spaced from the upper contact piece 216. In this case, this further contact piece 211 is likewise a metal cylinder. In order to bridge the space between the contact pieces 216 and 211 a projection 224 having essentially a tubular shape is provided at cylinder 6. At its upper end facing the contact piece 216 the projection 224 has a contact face 224*a* which cooperates with a corresponding contact face 216*a* of the contact piece 216. A further contact face 224*b* contacting contact piece 211 is provided at the lower end of projection 224.

In the illustrated embodiment, the projection 224 is disposed in the interior of the stationary contact piece 211 which is favorable with respect to the diameters. According to another embodiment of the invention (not shown), the projection 224 may also pass through the contact piece 211, which may possibly be slotted and thus projection 224 may be disposed essentially outside this contact piece.

The switch shown in FIG. 3 again partially coincides with the switch in FIG. 1.

In this embodiment, current is conducted through a stationary tubular contact piece 322 permanently connected with terminal 3, to the cylinder 6 which is enclosed by contact piece 322. At that end of the cylinder 6 which faces the fork 8 there is provided a circumferential projection which is designed as a contact face 323 and which slides on the inner wall of the contact piece 322 during movement of cylinder 6. The upper end of cylinder 6 carrying a contact face 317 which will conductively contact a contact face 316*a* of cylinder 316 when the switch is closed.

In the region of the movable power contact 5, the movable cylinder 6 is permanently connected with an insulating nozzle 312 from which exits the gas compressed during the switch-off switching path compressor 6, 7 to blow on the switching arc formed between the power contacts 4, 5.

This insulating nozzle 312 has a shield portion 313 which is slidingly guided in a stationary metal cylinder 316 connected to the upper terminal plate 2.

A cylindrical extension 313*a* of insulating material which is oriented toward the contact 4 is attached to the shield portion 313 and is aligned to be coaxial with the metal cylinder 313. With this design of the insulating nozzle, the flash-over resistance, that means the capability to avoid flash-over, is increased substantially and therefor the level of power which can be safely switched off is increased substantially.

The cylindrical extension 313*a*, whose axial length is matched to the length of the switching path, or movable contact travel path, has at its open end a circumferential projection 315*a* which rests against the inner wall of the metal cylinder 316. Advisably the interface between the metal cylinder 316 and the cylindrical extension 313*a* is made gastight. In order to hermetically seal or isolate the area 20 in which the arc plasma is disposed, a gasket 15, e.g. of Teflon, is provided in the projection 315*a*. The rated current contact path is matched to the power current path in such a manner that upon switch-off the rated current path opens shortly before the power current path opens so that the arc occurs only in the power current path.

Figure 3:
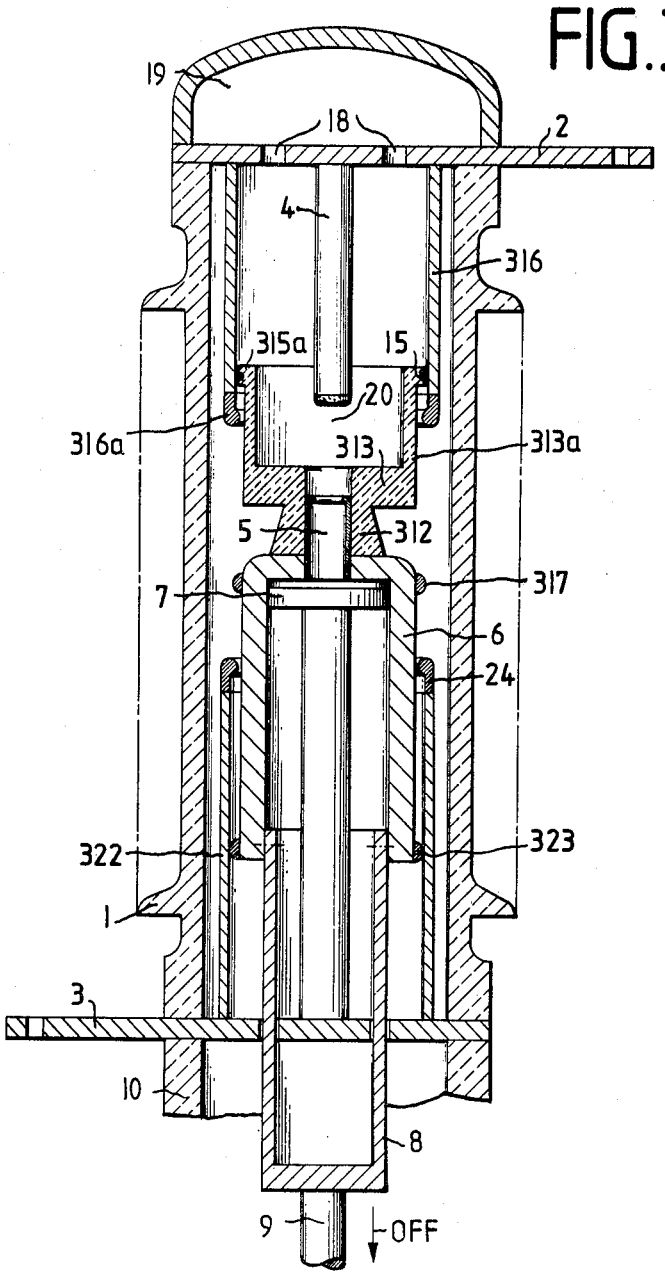

The switch shown in FIG. 3 operates as follows.

In the switched on state (not shown) current flows between the upper terminal plate 2 and the lower terminal plate 3 over the two current paths, the rated current path 316, 317 and the power current path 4,5, to the cylinder 6 and from there over the contact faces 323 to the contact piece 322 and to the terminal 3. The current can also flow from cylinder 6 through fork 8 to the high current contacts (not shown), which may be described with reference to FIG. 1.

If the drive rod 9 is then moved by the drive in the OFF direction, i.e. downwardly in the drawing, the two current paths are separated, as shown, path 316, 317 being opened first, and a switching arc forms between the power contacts 4 and 5. The switching path compressor 6,7, generates a high blast pressure thus causing the compressed insulating gas, usually $SF_6$, to exit upwardly through the insulating nozzle 311 and to blow on the arc, thus conveying the arc cloud, i.e. the plasma, from the region enclosed by the nozzle into the area 20 between the shield 313 and the stationary contact 4. The insulating gas can then escape through openings 18 in the upper terminal plate into the dome 19 of the switching chamber and can return through a filter into the switching chamber, as shown in FIG. 3.

Again various modifications of the embodiment shown in the drawing are conceivable without leaving the scope of the present invention.

Thus, various embodiments of the insulating nozzle or of its shield portion respectively, are conceivable; the significant part is that the area 20 in which the plasma cloud occurs must be substantially sealed by the metal cylinder 316 the projection 313*a* and the shield portion 313, if necessary with the aid of sealing means such as, for example, sealing gasket 15. This reduces the flashover capability, i.e. enormously increases the voltage carrying capability.

The stationary contact piece 316 of the rated current path may also be in the form of an external metalic coating on an insulating cylinder.

Modifications are also possible within the scope of the present invention with respect to the contacts. For example, FIG. 3 shows the contact faces 317 as 323, as circumferential projections on the cylinder 6. However, certain modifications are possible, and particularly, one or both contact faces may be provided directly in the cylinder wall.

Figure 4:
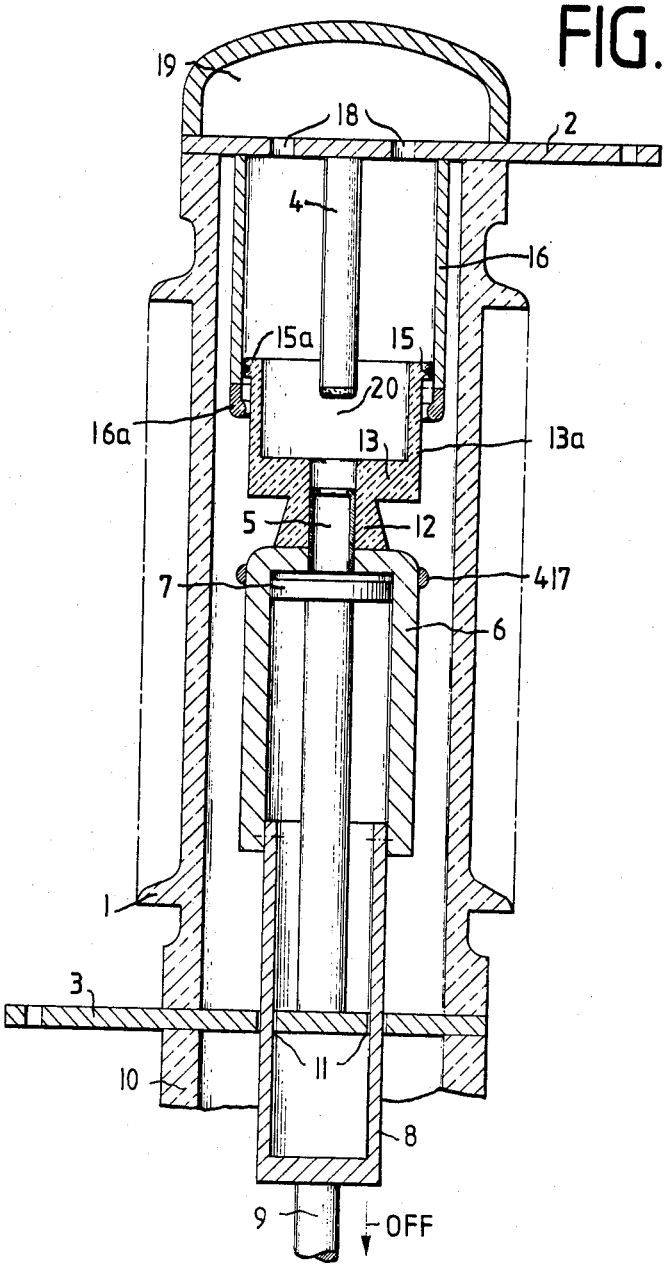

FIG. 4 shows an embodiment according to the invention in which only one contact face 417 is provided at the upper end of the cylinder 6 while contact at the bottom is provided by high current contacts 11, like those described with reference to FIG. 1.

Figure 5:
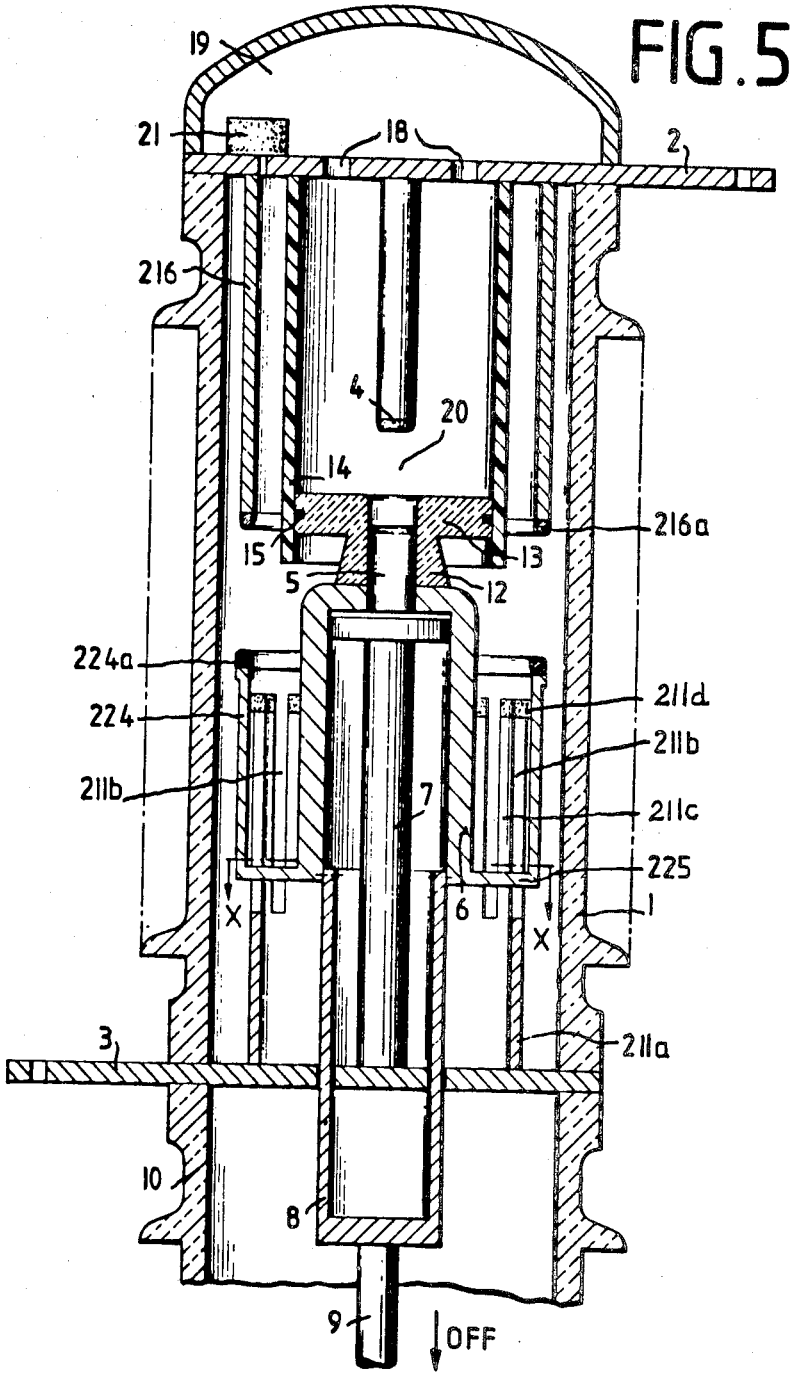
FIG. 5*a* is a sectional view along the line X—X of FIG. 5.
Figure 5A:
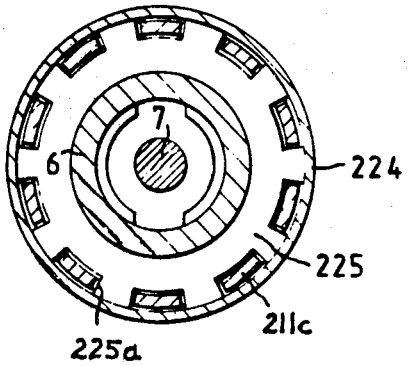

The switch shown in FIG. 5 partially coincides with the switch in FIG. 2. In this embodiment of the invention the projection 224 passes through slots 211*b* of the contact piece 211*a* and thus projection 224 may be disposed essentially outside this contact piece. At the upper end of the slotted contact piece 211*a* is a contact face 211*d* contacting the inner surface of the projection 224. The base 225 also has slots 225*a* through which the fingers 211*c* of the slotted contact piece 211*a* extend. The latter feature is shown in FIG. 5*a*.

It will be understood that the above description of the present invention is susceptible to various modifications, changes and adaptations, and the same are intended to be comprehended within the meaning and range of equivalents of the appended claims.

What is claimed is:

1. In a puffer-type gas blast circuit interrupter switch including means defining two separable power current conducting contacts between which an arc is created upon contact separation, a nozzle of insulating material disposed for directing a stream of gas against such arc, means including a stationary piston and a movable cylinder defining a compressor operable by separation movement of the contacts to supply a mass of gas under pressure to the nozzle, a cylindrical member surrounding the region in which such arc is created and the nozzle, a shield member forming part of the nozzle, shaped to correspond with the cylindrical member and slidingly engaging the cylindrical member for guiding movement of the nozzle relative to the cylindrical member, and means defining an interruptable rated current conducting path in parallel with the power current conducting contacts, the rated current conducting path being interruptable before separation of the power current conducting contacts, the improvement wherein said rated current conducting path means comprise two stationary contact pieces spaced from one another and a contact bridging member mounted on said cylinder for connecting said stationary contact pieces together when said switch is closed.

2. An arrangement as defined in claim 1 wherein at least one of said stationary contact pieces is in the form of a hollow cylinder.

3. An arrangement as defined in claim 1 or 2 wherein said contact bridging member has a tubular shape.

4. An arrangement as defined in claim 1 or 2 wherein said contact bridging member is located within one of said stationary contact pieces.

5. An arrangement as defined in claim 1 or 2 wherein said contact bridging member is located outside of one of said contact pieces and extends through said one contact piece.

6. An arrangement as defined in claim 1 wherein said separable contacts include a stationary contact and a movable contact, and said movable contact and said nozzle are fastened to said cylinder for movement therewith.

7. An arrangement as defined in claim 1 wherein at least one of said cylindrical member and shield member comprises a tube of insulating material.

8. An arrangement as defined in claim 1 wherein at least one of said cylindrical member and said shield member comprises a metal tube.

9. An arrangement as defined in claim 1 wherein one of said separable contacts and said cylindrical member are stationary and said cylindrical member concentrically surrounds, and projects in its axial direction beyond, said stationary separable contact.

10. An arrangement as defined in claim 1 further comprising sealing means mounted between said cylindrical member and said shield member for establishing a hermetic seal therebetween.

11. An arrangement as defined in claim 10 wherein said cylindrical member is of metal, and said shield member comprises a cylindrical extension oriented coaxially with said cylindrical member and carrying said sealing means, whereby said cylindrical member and said shield member with its said extension enclose the region in which the arc is created.

12. An arrangement as defined in claim 1 wherein said cylindrical member is of metal, and said shield member comprises a cylindrical extension oriented coaxially, and in sliding contact, with said cylindrical member, whereby said cylindrical member and said shield member with its said extension enclose the region in which the arc is created.

* * * * *